US006921324B1

(12) United States Patent
Chang et al.

(10) Patent No.: US 6,921,324 B1
(45) Date of Patent: Jul. 26, 2005

(54) PAD BACKER

(75) Inventors: Li-Min Chang, Hsinchu (TW); Tony Liao, Hsinchu (TW); C. W. Pao, Hsinchu (TW); Justin Huang, Hsinchu (TW)

(73) Assignee: United Microelectronics Corp., Hsinchu (TW)

( * ) Notice: Subject to any disclaimer, the term of this patent is extended or adjusted under 35 U.S.C. 154(b) by 0 days.

(21) Appl. No.: 10/710,819

(22) Filed: Aug. 5, 2004

(51) Int. Cl.[7] ..... B24B 29/00
(52) U.S. Cl. ..... 451/288; 451/289
(58) Field of Search ..... 451/285, 286, 451/287, 288, 289

(56) References Cited

U.S. PATENT DOCUMENTS 5,931,719 A * 8/1999 Nagahara et al. ..... 451/41
6,095,900 A * 8/2000 Fruitman et al. ..... 451/28
6,336,851 B1 * 1/2002 Shendon ..... 451/303
6,390,891 B1 * 5/2002 Guha et al. ..... 451/41
2003/0110609 A1 * 6/2003 Taylor ..... 29/402.03
2003/0228836 A1 * 12/2003 Lombardo et al. ..... 451/533
2004/0072502 A1 * 4/2004 Taylor ..... 451/28

* cited by examiner

*Primary Examiner*—Jacob K. Ackun, Jr.
(74) *Attorney, Agent, or Firm*—Jianq Chyun IP office

(57) ABSTRACT

A pad backer is described, comprising a backing plate, an elastomer layer and a pad backing ring. The elastomer layer has a bottom surface bonded to the backing plate and an upper surface with a protrudent part at the edge portion thereof. The pad backing ring has an inner bottom surface with a recessed part thereon matching with the protrudent part on the upper surface of the elastomer layer, such that the elastomer layer is fixed onto the pad backing ring through engagement of the protrudent part and the recessed part.

13 Claims, 2 Drawing Sheets

PAD BACKER

BACKGROUND OF INVENTION

1. Field of the Invention

The present invention relates to a tool used in semiconductor processes. More particularly, the present invention relates to a structure of a pad backer used in a chemical mechanical polishing (CMP) process. The pad backer has a longer lifetime and is capable of not damaging the surface of the polished object when broken in use.

2. Description of Related Art

CMP is the most important technique for globally planarizing a substrate surface. In a typical CMP process, the substrate to be polished is pressed onto a polishing pad to which polishing slurry is supplied, while the polishing pad is placed on a rotated polishing stage of the CMP machine. The polishing pad is usually placed on a flat pad backer that is mounted on the polishing stage and rotated together with the polishing stage.

FIGS. 1A and 1B illustrate a conventional pad backer in an exploded perspective view and in a cross-sectional view, respectively. The conventional pad backer 100 includes a thin stainless steel plate 110, a polyurethane (PU) layer 120 and a pad backing ring 130, wherein the PU layer 120 is fixed onto the stainless steel plate 110 via a back adhesive 140 and rivets 150. The PU layer 120 carries a polishing pad 10 in a CMP process, and the pad backing ring 130 is for keeping the stainless steel plate 110 on the polishing stage. The PU layer 120 is smaller than the stainless steel plate 110, so that a gap 160 is formed between the PU layer 120 and the pad backing ring 130. During a CMP process, the stainless steel plate 110, the PU layer 120 and the polishing pad 10 together are slightly swollen upward by a gas blast from below, so that the substrate can well contact with the polishing pad.

As mentioned above, the polishing pad 10 and the underlying PU layer 120 are pressed by a substrate and rotated relative to the substrate in a CMP process. Therefore, a shear stress is generated between the PU layer 120 and the stainless steel plate 110. Meanwhile, the polishing slurry that usually contains corrosive components inevitably flows through the gap 160 and contacts with the back adhesive 140 between the PU layer 120 and the stainless steel plate 110 to degrade it. Therefore, the PU layer 120 will be delaminated from the stainless steel plate 110 usually after the pad backer 100 is used for polishing 1500 pieces of wafers. Once the delamination occurs in a CMP process, the rivets 150 are pulled away because of the shear stress caused by the polishing operation, and the wafer being polished will be damaged severely by the rivets 150.

SUMMARY OF INVENTION

In view of the foregoing, this invention is directed to a durable pad backer that is capable of not damaging the surface of the polished object when broken in use.

The pad backer of this invention includes a backing plate, an elastomer layer and a pad backing ring. The elastomer layer has a bottom surface bonded to the backing plate, and the pad backing ring has an inner portion engaged with the edge portion of the upper surface of the elastomer layer for fixing the elastomer layer onto the pad backing ring.

In an embodiment of this invention, the upper surface of the elastomer layer has at least one protrudent part or recessed part at the edge portion thereof, and the inner portion of the pad backing ring has a bottom surface with at least one recessed part or protrudent part thereon matching with the protrudent part or the recessed part on the elastomer layer. The elastomer layer is fixed onto the pad backing ring through engagement of the protrudent part and the recessed part.

In the above pad backer, the elastomer layer may have the same size of the backing plate, so that the bonding area between the elastomer layer and the backing plate is larger than before. Therefore, the shear stress per unit area of adhesive is reduced. Meanwhile, the engagement of the protrudent part and the recessed part matching with each other prevents access of the polishing slurry to the adhesive, so that the adhesive is not corroded by the polishing slurry. Consequently, the adhesive is deteriorated more slowly, thereby increasing the lifetime or the durability of the pad backer. Moreover, since the elastomer layer is fixed onto the pad backing ring, the use of rivets could be avoided in the pad backer of this invention. Therefore, when the pad backer is broken in use, the surface of the object being polished will not be damaged by the pad backer in absence of rivets.

It is to be understood that both the foregoing general description and the following detailed description are exemplary, and are intended to provide further explanation of the invention as claimed.

BRIEF DESCRIPTION OF DRAWINGS

The accompanying drawings are included to provide a further understanding of the invention, and are incorporated in and constitute a part of this specification. The following drawings illustrate embodiments of the invention and, together with the description, serve to explain the principles of the invention.

DETAILED DESCRIPTION

Figure 2A:
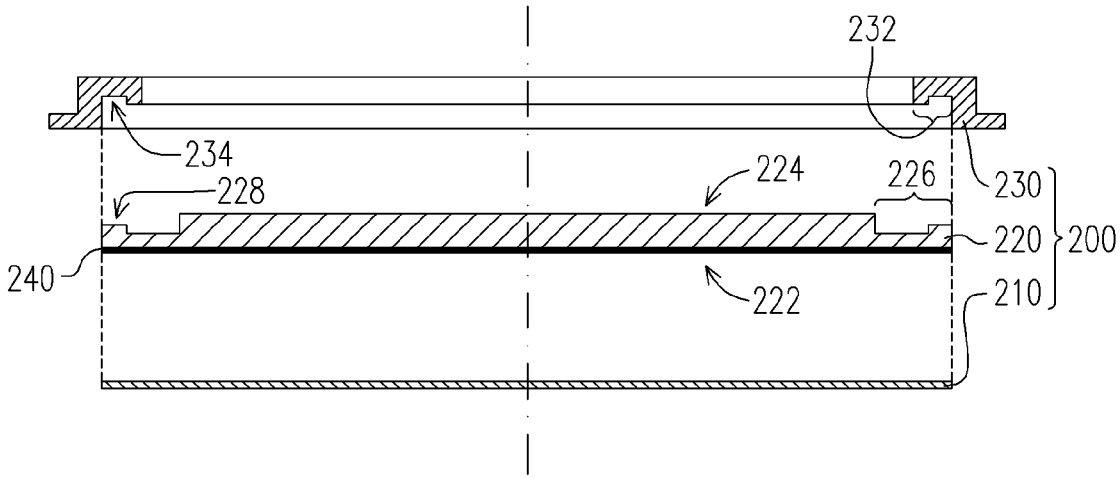
FIGS. 2A and 2B illustrate a pad backer according to an embodiment of this invention in an exploded cross-sectional view and in a cross-sectional view, respectively.
Figure 2B:
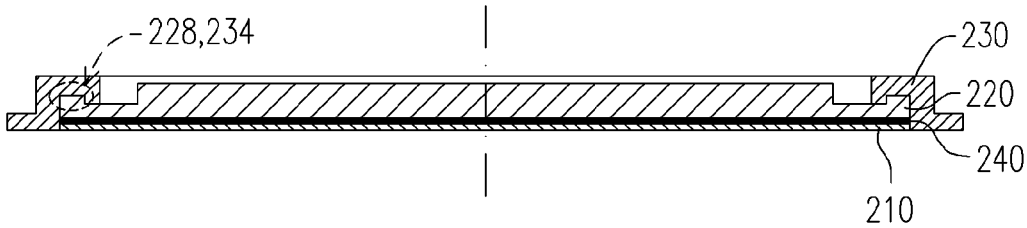

FIGS. 2A and 2B illustrate a pad backer according to an embodiment of this invention in an exploded cross-sectional view and in a cross-sectional view, respectively.

Referring to FIGS. 2A and 2B, the pad backer 200 according to an embodiment of this invention includes a backing plate 210, an elastomer layer 220 and a pad backing ring 230. The material of the backing plate 210 is, for example, stainless steel or other anti-corrosion material having high rigidity, while the backing plate 210 is sufficiently thin so that it can be swollen upward by a gas blast from below.

Figure 1A:
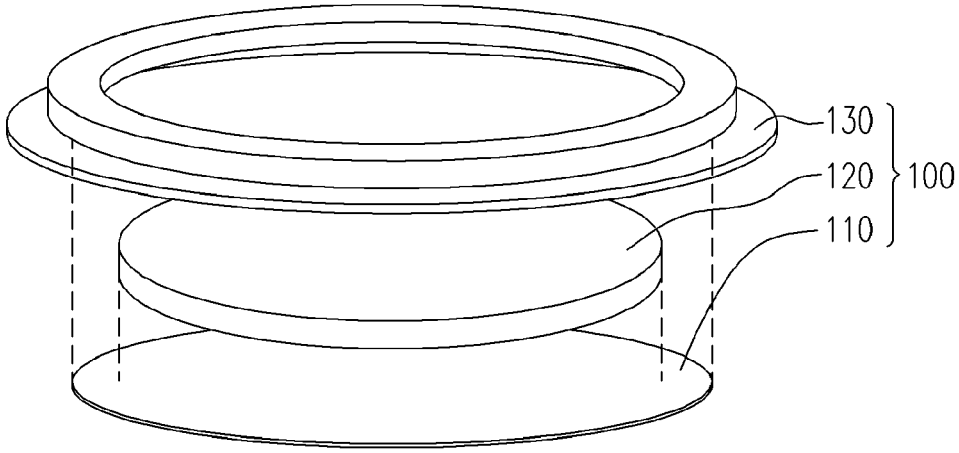
FIG. 1A (PRIOR ART)
FIGS. 1A and 1B illustrate a conventional pad backer in an exploded perspective view and in a cross-sectional view, respectively.
Figure 1B:
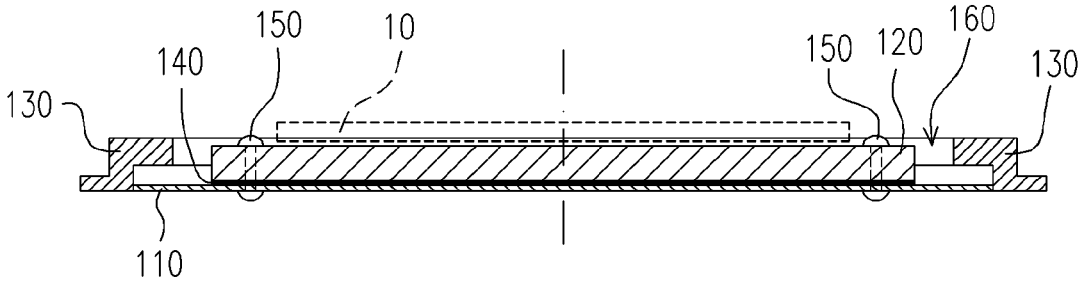
FIG. 1B (PRIOR ART)

The elastomer layer 220 has a bottom surface 222 bonded to the backing plate 210 with an adhesive 240, and the edge portion 226 of the upper surface 224 of the elastomer layer 220 has a protrudent part 228 thereon. The elastomer layer 220 is larger than the elastomer layer 120 in the conventional pad backer 100 (FIG. 1B) and may even have the same size of the backing plate 210, while the additional part of the elastomer layer 220 is for forming the protrudent part 228. The material of the elastomer layer 220 is, for example, polyurethane (PU) or other anticorrosion elastomer, and the elastomer layer 220 with a protrudent part 228 can be molded as a whole using a die having a cavity of the corresponding shape.

The pad backing ring 230 has an inner portion with a bottom surface 232, on which a recessed part 234 is formed. The recessed portion 234 matches with the protrudent part 228 at the edge portion 226 of the elastomer layer 220, so that the elastomer layer 220 can be fixed onto the pad backing ring 230 through engagement of the recessed part 234 and the protrudent part 228. The material of the pad backing ring 230 is, for example, stainless steel or other anti-corrosion material.

Though the recessed part is formed on the pad backing ring and the protrudent part on the elastomer layer in the above embodiment of this invention, the recessed part and the protrudent part may be alternatively formed on the elastomer layer and the pad backing ring, respectively. Furthermore, there can be more than one such pair of recessed part and protrudent part formed on the elastomer layer and the pad backing ring, and each of the elastomer layer and the pad backing ring may simultaneously have at least one recessed part and at least one protrudent part. In addition, the shapes of the protrudent part and/or the recessed part may also be modified to reinforce the bond between the elastomer layer and the pad backing ring.

Since the bonding area between the elastomer layer and the backing plate in the pad backer of this invention is larger than before, the shear stress per unit area of adhesive is reduced. Meanwhile, since the engagement of the protrudent part and the recessed part matching to each other prevents access of the polishing slurry to the adhesive, the adhesive is not corroded by the polishing slurry. Consequently, the adhesive is deteriorated more slowly, thereby increasing the lifetime or the durability of the pad backer. Moreover, since the elastomer layer is fixed onto the pad backing ring, the use of rivets could be avoided in the pad backer according to the present embodiment of this invention. Therefore, when the pad backer is broken in use, the surface of the object being polished will not be damaged by the pad backer of this invention in absence of rivets.

It will be apparent to those skilled in the art that various modifications and variations can be made to the structure of the present invention without departing from the scope or spirit of the invention. In view of the foregoing, it is intended that the present invention covers modifications and variations of this invention provided they fall within the scope of the following claims and their equivalents.

What is claimed is:

1. A pad backer, comprising:

a backing plate;

an elastomer layer, having a bottom surface bonded to the backing plate and an upper surface with at least one protrudent part or recessed part at an edge portion thereof; and a pad backing ring, having an inner bottom surface with at least one recessed part or protrudent part thereon matching with the protrudent part or the recessed part on the upper surface of the elastomer layer, such that the elastomer layer is fixed onto the pad backing ring through engagement of the protrudent part and the recessed part.

2. The pad backer of claim 1, wherein the recessed part is on the inner bottom surface of the pad backing ring and the protrudent part on the edge portion of the upper surface of the elastomer layer.

3. The pad backer of claim 1, wherein the backing plate and the elastomer layer has the same lateral area.

4. The pad backer of claim 1, wherein the elastomer layer is bonded to the backing plate via an adhesive.

5. The pad backer of claim 1, wherein the backing plate comprises stainless steel.

6. The pad backer of claim 1, wherein the elastomer layer comprises polyurethane (PU).

7. The pad backer of claim 1, wherein the pad backing ring comprises stainless steel.

8. A pad backer, comprising:

a backing plate;

an elastomer layer, having a bottom surface bonded to the backing plate; and a pad backing ring, having an inner portion engaged with an edge portion of an upper surface of the elastomer layer for fixing the elastomer layer onto the pad backing ring.

9. The pad backer of claim 8, wherein the backing plate and the elastomer layer has the same lateral area.

10. The pad backer of claim 8, wherein the elastomer layer is bonded to the backing plate via an adhesive.

11. The pad backer of claim 8, wherein the backing plate comprises stainless steel.

12. The pad backer of claim 8, wherein the elastomer layer comprises polyurethane (PU).

13. The pad backer of claim 8, wherein the pad backing ring comprises stainless steel.

* * * * *